US012414633B1

(12) United States Patent
Song

(10) Patent No.: US 12,414,633 B1
(45) Date of Patent: Sep. 16, 2025

(54) MODULAR SOFA

(71) Applicant: VOSSON INC, Tustin, CA (US)

(72) Inventor: Tongpei Song, Heze (CN)

(73) Assignee: VOSSON INC, Tustin, CA (US)

( * ) Notice: Subject to any disclaimer, the term of this patent is extended or adjusted under 35 U.S.C. 154(b) by 0 days.

(21) Appl. No.: 18/963,680

(22) Filed: Nov. 28, 2024

(51) Int. Cl.
*A47C 13/00* (2006.01)
*A47C 15/00* (2006.01)
*A47C 17/23* (2006.01)

(52) U.S. Cl.
CPC ..... *A47C 13/005* (2013.01); *A47C 15/002* (2013.01); *A47C 17/23* (2013.01)

(58) Field of Classification Search
CPC ..... A47C 13/005; A47C 17/23; A47C 17/34; A47C 17/36; A47C 17/163; A47C 17/2073; A47C 15/002
See application file for complete search history.

(56) References Cited

U.S. PATENT DOCUMENTS 3,973,800 A * 8/1976 Kogan ..... A47C 7/002 297/135
5,794,283 A * 8/1998 Vila ..... A47C 17/2073 5/18.1
11,517,117 B1 * 12/2022 Sun ..... A47C 7/42
12,070,131 B2 * 8/2024 Nelson ..... A47C 4/02
2005/0046243 A1 * 3/2005 Cimino ..... A47C 7/42 297/124
2007/0136945 A1 * 6/2007 Patella ..... F16B 12/60 5/52
2021/0337974 A1 * 11/2021 Chen ..... A47C 4/028
2024/0298806 A1 * 9/2024 Kamal El Din ..... A47C 17/132
2024/0358156 A1 * 10/2024 Wu ..... A47C 7/546

FOREIGN PATENT DOCUMENTS

CN 106617882 A 5/2017
CN 108652277 A * 10/2018
CN 211559479 U 9/2020
CN 214072618 U 8/2021
EP 1384425 A1 * 1/2004 ..... A47C 17/165

* cited by examiner

*Primary Examiner* — Justin C Mikowski
*Assistant Examiner* — Alison N Labarge
(74) *Attorney, Agent, or Firm* — George D. Morgan

(57) ABSTRACT

The present invention provides a modular sofa includes: at least one pull-out sofa bed module, and at least one module of a single seat module, a corner seat module, an ottoman module, and a love seat module. Various modules are connected to each other through a second type of connecting member. The pull-out sofa bed module includes a second base portion, a second backrest portion, and a pull-out portion, where the second backrest portion is configured to provide leaning support for a user, the pull-out portion may be extended and retracted relative to the second base portion, when the pull-out portion is pulled into the second base portion, the pull-out sofa bed module is used as a sofa, and when the pull-out portion is pulled out of the second base portion, the pull-out sofa bed module is used as a sofa bed.

15 Claims, 19 Drawing Sheets

20

80C

MODULAR SOFA

TECHNICAL FIELD

The present application relates to the technical field of furniture manufacturing, and in particular, to a modular sofa.

BACKGROUND

In the existing furniture market, although there is a certain degree of flexibility and customization for a modular sofa, there are still many limitations. A traditional modular sofa usually has a single function, cannot meet the dual needs of being a sofa and a bed at the same time, has a large size, and does not meet a package size limitation of an express delivery company, resulting in high transportation and carrying costs. In addition, an existing modular sofa is usually fixed in combination form, lacks variability, and requires an additional tool for assembly, increasing the difficulty of use for a user; and the design lacking storage space is particularly inconvenient for a small-sized apartment.

SUMMARY

To solve the above problems, embodiments of the present application provide a modular sofa, which includes: at least one pull-out sofa bed module, where the pull-out sofa bed module includes a second base portion, a second backrest portion, and a pull-out portion, where the second backrest portion is configured to provide leaning support for a user, the pull-out portion may be extended and retracted relative to the second base portion, when the pull-out portion is pulled into the second base portion, the pull-out sofa bed module is used as a sofa, and when the pull-out portion is pulled out of the second base portion, the pull-out sofa bed module is used as a sofa bed; and the second base portion and the second backrest portion are connected through a first type of connecting member; and at least one module of a single seat module, a corner seat module, an ottoman module, and a love seat module, where the pull-out sofa bed module, the corner seat module, and the love seat module are connected through a second type of connecting member.

Optionally, the first type of connecting member includes a first inserting slot and a first inserting head matched with the first inserting slot, where a width of the first inserting slot and a width of the first inserting head gradually decrease along an inserting direction.

Optionally, the second type of connecting member includes a second inserting slot and a second inserting head matched with the second inserting slot, and the second inserting slot includes a first inserting slot wall, a second inserting slot wall, and a third inserting slot wall that are sequentially arranged in parallel, and a connecting wall connected to the first inserting slot wall, the second inserting slot wall, and the third inserting slot wall, where the first inserting slot wall and the third inserting slot wall are located on a same plane and are symmetrical relative to the second inserting slot wall, and the second inserting slot wall protrudes outward relative to the first inserting slot and the third inserting slot wall, to form a receiving slot with an upward opening.

Optionally, the modular sofa includes the pull-out sofa bed module and an armrest module.

Optionally, pulling between the pull-out portion and the second base portion is implemented through a slide rail system, where a slide rail is disposed on each of two sides in the second base portion, a slide bar is correspondingly disposed on the pull-out portion, and a limiting angle iron is disposed at a tail end of the slide rail.

Optionally, the pull-out portion is provided with a bed-forming hinge, so that a top surface of the pull-out portion is raised or lowered along a predetermined path.

Optionally, the single seat module includes a first base portion and a first backrest portion that are detachable, where the first base portion is configured to allow the user to sit on the first base portion, and the first backrest portion is configured to provide leaning support for the user; and the first base portion and the first backrest portion are connected through the first type of connecting member.

Optionally, the love seat module includes a sixth base portion and a sixth backrest portion that are detachable, where the sixth base portion is configured to allow at least two users to sit on the sixth base portion, and the sixth backrest portion is configured to provide leaning support for the user; the sixth base portion and the sixth backrest portion are connected through the first type of connecting member; and a width of the sixth base portion is greater than or equal to twice a width of the first base portion.

Optionally, the corner seat module includes a third base portion and a third backrest portion that are detachable, where the third base portion is configured to allow the user to sit on the third base portion, the third backrest portion includes two backrest portions that are detachable, and the two backrest portions are disposed on two adjacent side walls of the third base portion respectively after being assembled, to form backrest structures that are adjacent and perpendicular to each other.

Optionally, the ottoman module includes a fourth base portion, and the fourth base portion further includes a top cover, a bottom plate, and a side wall connected to the top cover and the bottom plate, where the top cover is of a flap structure and may rotate relative to the side wall; when the top cover is closed, the top cover, the bottom plate, and the side wall are enclosed to form closed storage space; and when the top cover is opened, a part of the top cover is raised upward, and the other part thereof is flipped downward to enter the storage space.

Optionally, the ottoman module is connected to another module through a third type of connecting member, and the third type of connecting member includes a first side wall, a second side wall, and a connecting wall connected to the first side wall and the second side wall, where the first side wall is in parallel and opposite to the second side wall, to form a first gap for accommodating side walls of two to-be-connected modules, and the connecting wall is perpendicular to the first side wall.

Optionally, the armrest module includes a left-side armrest portion and/or a right-side armrest portion; and the armrest module is connected to the single seat module, the pull-out sofa bed module, the corner seat module, or the love seat module through the second type of connecting member.

Optionally, the modular sofa includes: one corner seat module; one pull-out sofa bed module, configured to be connected to a first side surface of the corner seat module; and one love seat module, configured to be connected to a second side surface of the corner seat module, where the first side surface is adjacent to the second side surface.

Optionally, the modular sofa includes: one love seat module; two corner seat modules, respectively being a first corner seat module and a second corner seat module, where the first corner seat module is configured to be connected to a first side surface of the love seat module, the second corner seat module is configured to be connected to a second side surface of the love seat module, and the first side surface is opposite to the second side surface; and two pull-out sofa bed modules, respectively being a first pull-out sofa bed module and a second pull-out sofa bed module, where the first pull-out sofa bed module is configured to be connected to the first corner seat module, and the second pull-out sofa bed module is configured to be connected to the second corner seat module.

Optionally, the modular sofa includes: one pull-out sofa bed module; two single seat modules, respectively being a first single seat module and a second single seat module, where the first single seat module is configured to be connected to a first side surface of the pull-out sofa bed module, the second single seat module is configured to be connected to a second side surface of the pull-out sofa bed module, and the first side surface is opposite to the second side surface; and two ottoman modules, respectively configured to be connected to the first single seat module and the second single seat module.

The present application further provides a modular sofa, which includes: a pull-out sofa bed module, including: a second base portion, a second backrest portion, and a pull-out portion, where the second backrest portion is configured to provide leaning support for a user, the pull-out portion may be extended and retracted relative to the second base portion, when the pull-out portion is pulled into the second base portion, the pull-out sofa bed module is used as a sofa, and when the pull-out portion is pulled out of the second base portion, the pull-out sofa bed module is used as a sofa bed; a love seat module, including a sixth base portion and a sixth backrest portion, where the sixth base portion is configured to allow at least two users to sit on the sixth base portion, and the sixth backrest portion is configured to provide leaning support for the user; and a corner seat module, including a third base portion and a third backrest portion, where the third backrest portion is disposed on a first side wall and a second side wall that are adjacent and that are of the third base portion, to form backrest structures that are adjacent and basically perpendicular to each other; and a third side wall of the third base portion is opposite to the first side wall and is configured to be connected to the pull-out sofa bed module, and a fourth side wall of the third base portion is opposite to the second side wall and is configured to be connected to the love seat module.

Compared with the prior art, the technical solutions provided in the embodiments of the present application have the following advantages:

The present invention provides an improved modular sofa design, which may integrate sofa and bed functions, optimize a size to adapt to a transportation standard, increase flexibility of combinations, simplify a mounting process, and provide a storage function, thereby improving user experience and meeting diversified requirements of a modern family.

BRIEF DESCRIPTION OF THE DRAWINGS

To describe the technical solutions in the embodiments of the present application or in the prior art more clearly, the following briefly introduces the accompanying drawings required for describing the embodiments or the prior art. Apparently, the accompanying drawings in the following description are only the embodiments of the present application, and those of ordinary skill in the art may still derive other accompanying drawings from these accompanying drawings without creative efforts.

DETAILED DESCRIPTION OF THE EMBODIMENTS

To make the purposes, technical solutions, and advantages of the present disclosure clearer, the following further describes the present disclosure in detail with reference to the accompanying drawings. Apparently, the described embodiments are merely some rather than all of embodiments of the present disclosure. All other embodiments obtained by those of ordinary skill in the art based on the embodiments of the present disclosure without any creative efforts shall fall within the protection scope of the present disclosure.

It should be noted that, the terms "include", "comprise", or any other variants are intended to cover non-exclusive inclusion, so that a commodity or device including a series of elements includes not only those elements but also other elements not explicitly listed, or further includes inherent elements of such commodity or device. An element defined by "includes a . . . " does not, without more constraints, preclude the existence of additional identical elements in the commodity or device that includes the element.

It can be known from the background that an existing modular sofa still has a plurality of limitations and is low in practicability. Specific problems are as follows:

According to a modular sofa in the prior art, sofa and bed functions are usually separated, and requirements of two functions cannot be met at the same time. In addition, a bed-forming function needs to be implemented by using an additional module, which increases purchase costs of a consumer and space occupation, resulting in a waste of resources.

An existing sofa bed product usually exceeds 130 inches in a package size, which not only increases transportation space and human costs of an express delivery company, but also makes product carrying more difficult. For the consumer, this means higher purchase and movement costs, particularly challenges faced during moving.

An existing modular sofa design is relatively fixed in a combination manner and cannot meet requirements of different families for personalized combination. Most products only provide a basic sofa function and lack an ability to convert into sofa beds.

Assembly of an existing modular sofa usually requires an additional tool and connecting member, which not only increases complexity of mounting, but also affects use experience of the consumer and immediate usability of the product due to possible accessory missing during manual operation.

The existing modular sofa design does not consider a storage requirement, and particularly, in a small-sized apartment, storage space is extremely valuable. However, an existing sofa design does not provide an effective storage solution.

In view of the above problem, the present invention provides an improved modular sofa design, aiming to overcome at least one or more deficiencies in the prior art.

Optional embodiments of the present disclosure are described below in detail with reference to the accompanying drawings.

Figure 9:
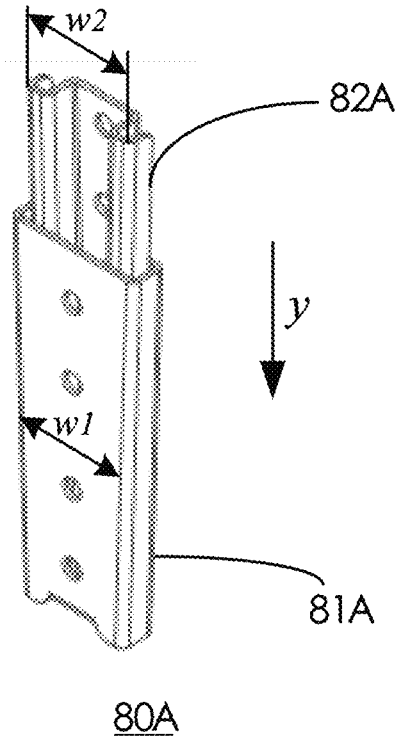
FIG. 9 is an optional schematic structural diagram of a connecting member related to a modular sofa according to the present invention.
Figure 10:
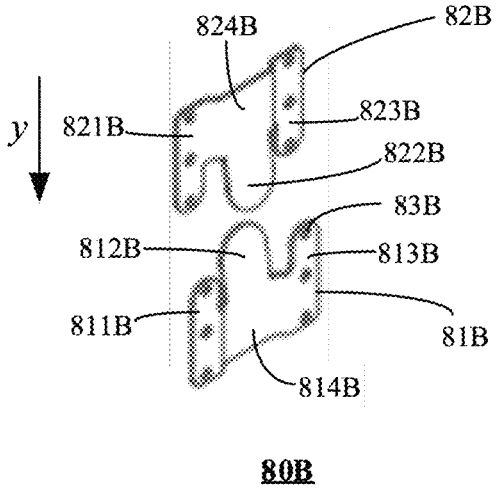
FIG. 10 is another optional schematic structural diagram of a connecting member related to a modular sofa according to the present invention.
Figure 11:
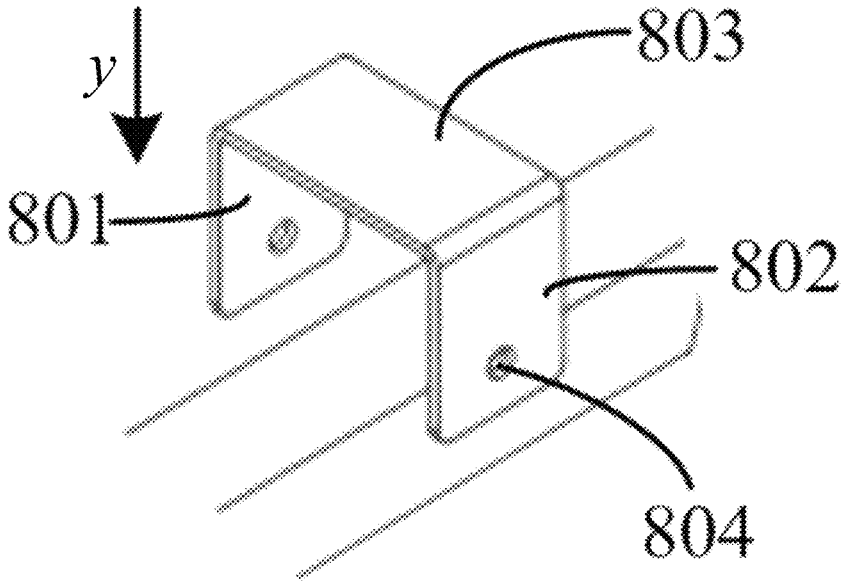
FIG. 11 is still another optional schematic structural diagram of a connecting member related to a modular sofa according to the present invention.

FIG. 1 to FIG. 8 are various modules that may be involved in a modular sofa according to some embodiments of the present disclosure, which are a single seat module 10, a pull-out sofa bed module 20, a corner seat module 30, an ottoman module 40, an armrest module 50, a love seat module 60 sequentially. FIG. 9 to FIG. 11 are schematic structural diagrams of optional connecting members of a modular sofa according to some embodiments of the present disclosure. FIG. 12 to FIG. 19 are schematic structural diagrams of modular sofas according to some embodiment of the present disclosure.

Figure 1:
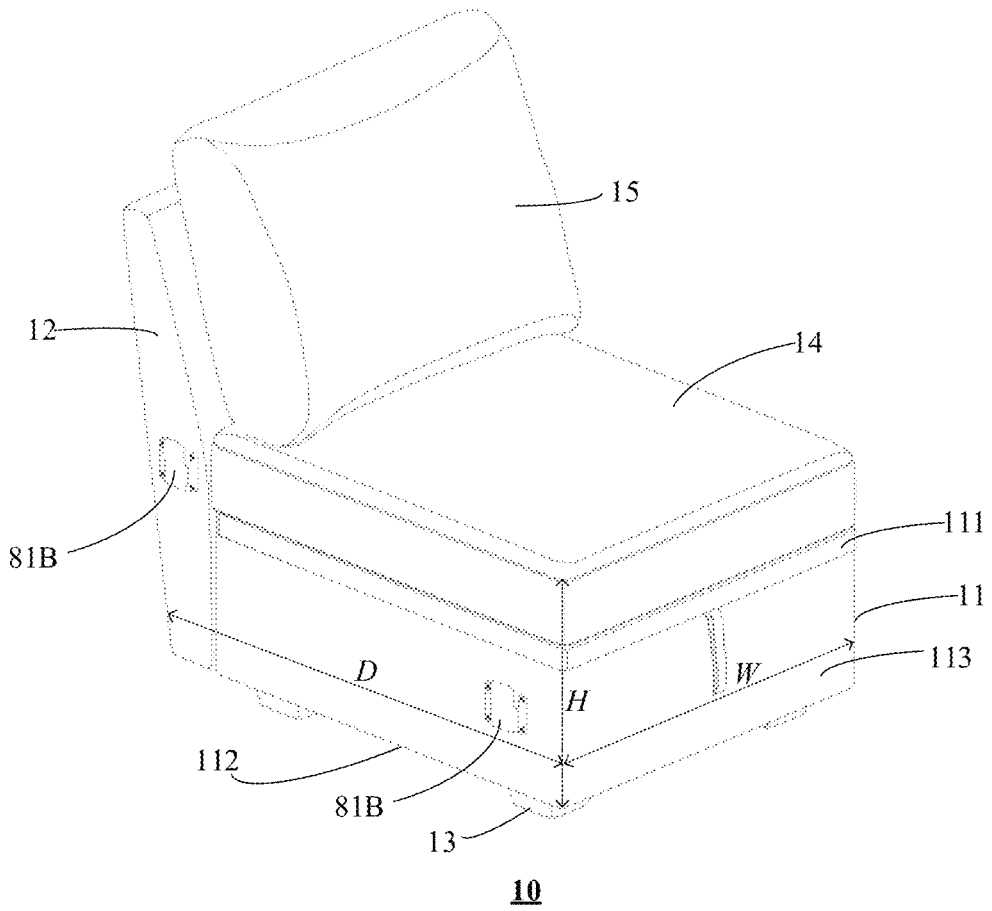
FIG. 1 is a schematic structural diagram of a single seat module related to a modular sofa according to the present invention.
Figure 2:
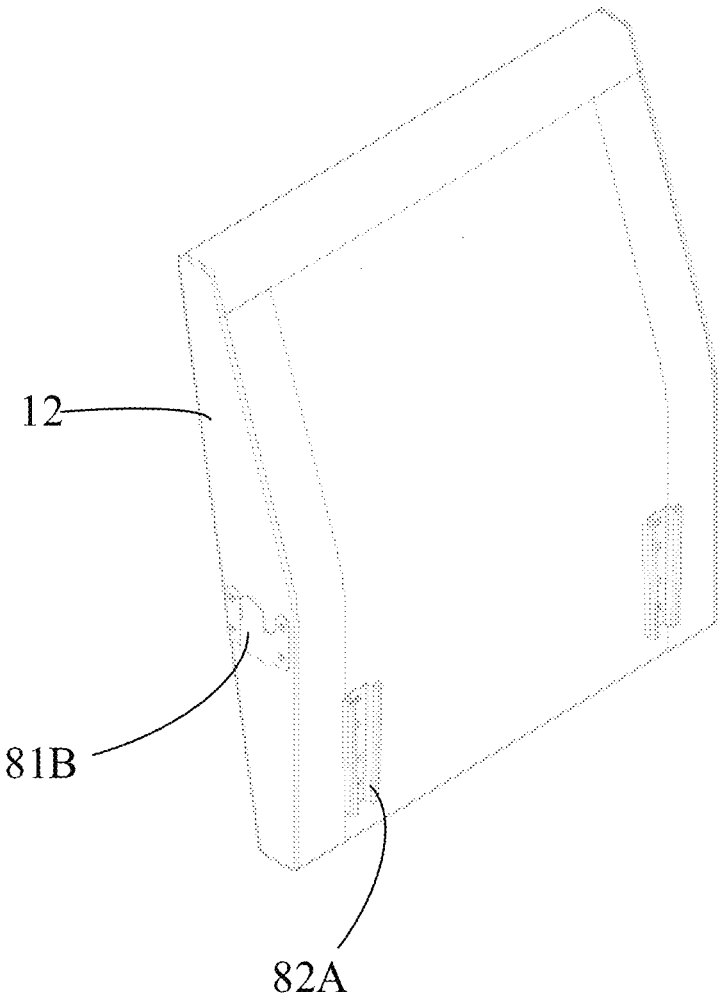
FIG. 2 is a schematic structural diagram of a backrest portion related to a modular sofa according to the present invention.

Referring to FIG. 1 and FIG. 2, the single seat module 10 further includes a first base portion 11 and a first backrest portion 12 that are detachable. The first base portion 11 may allow a user to sit or lie on the first base portion and provide solid support for the user. The first backrest portion 12 may provide stable leaning support for the user.

In some embodiments, the first base portion 11 further includes: a top cover 111, a bottom plate 112, and a side wall 113 connected to the top cover 111 and the bottom plate 112, where the top cover 111, the bottom plate 112, and the side wall 113 may be jointly enclosed to form storage space. In some embodiments, the top cover 111 of the first base portion 11 may be of a flap structure, and an item in the storage space may be accessed by opening the top cover 111. The storage space may be configured to store a living sundry, an accessory of the modular sofa, and the like, thereby increasing practicability of the modular sofa.

The first base portion 11 and the first backrest portion 12 may be rapidly connected or detached without assistance of another tool during connection or detachment. Specifically, the first base portion 11 and the first backrest portion 12 are rapidly connected or detached through a connecting member, the connecting member further includes an inserting slot and an inserting head matched with the inserting slot, and the inserting slot and the inserting head may be connected through insertion, thereby allowing the user to detach and assemble the single seat module 10 simply, conveniently, and rapidly. Specifically, in some embodiments, the inserting slot is disposed on the first base portion 11, to form a receiving slot with an upward opening on a side surface of the first base portion 11, and the inserting head is disposed on the first backrest portion 12, to form an inserting head extending downward on a side surface of the first backrest portion 12, so that the first backrest portion 12 may be easily embedded in or hung on the first base portion 11.

In some embodiments, as shown in FIG. 9, the first base portion 11 and the first backrest portion 12 may be rapidly connected or detached through a first type of connecting member 80A. The first type of connecting member 80A further includes a first inserting slot 81A and a first inserting head 82A matched with the first inserting slot 81A. The first inserting slot 81A is disposed on the first base portion 11, to form a receiving slot with an upward opening on a side wall 113 of the first base portion 11, and the first inserting head 82A is disposed on the first backrest portion 12, to form an inserting head extending downward on a side surface of the first backrest portion 12. Shapes of the first inserting slot 81A and the first inserting head 82A are similar to V shapes or isosceles trapezoid shapes. A width w1 of the first inserting slot 81A gradually decreases along an inserting direction y, and correspondingly, a width w2 of the first inserting head 82A also gradually decreases along the inserting direction y. The above first type of connecting member 80A may ensure that the first inserting slot 81A and the first inserting head 82A are stably connected after being assembled, to prevent a connecting structure from loosening during use. In addition, the above connecting structure may enhance a bearing capability, to effectively support the first backrest portion 12.

In some embodiments, the single seat module 10 may further include a foot pad 13, and the foot pad 13 is located on the bottom plate 112 of the first base portion 11. The foot pad 13 may improve stability of the sofa. In some embodiments, the foot pad 13 may further be equipped with a roller wheel, to facilitate moving the sofa by the user. The foot pad 13 may be designed to be of a detachable structure. In some embodiments, an inserting hole used to be connected to the foot pad 13 is formed on the bottom plate 112 of the first base portion 11, and the foot pad 13 may be inserted into the bottom plate 112 of the base portion 11, to facilitate cleaning and replacement.

In some embodiments, the single seat module 10 further includes a base portion cushion 14, and a backrest portion cushion 15, which are configured to improve comfort during use. The base portion cushion 14 and the backrest portion cushion 15 may be stored in the storage space and taken out or accommodated from the storage space as required, thereby providing a flexible use manner for the user.

Figure 3:
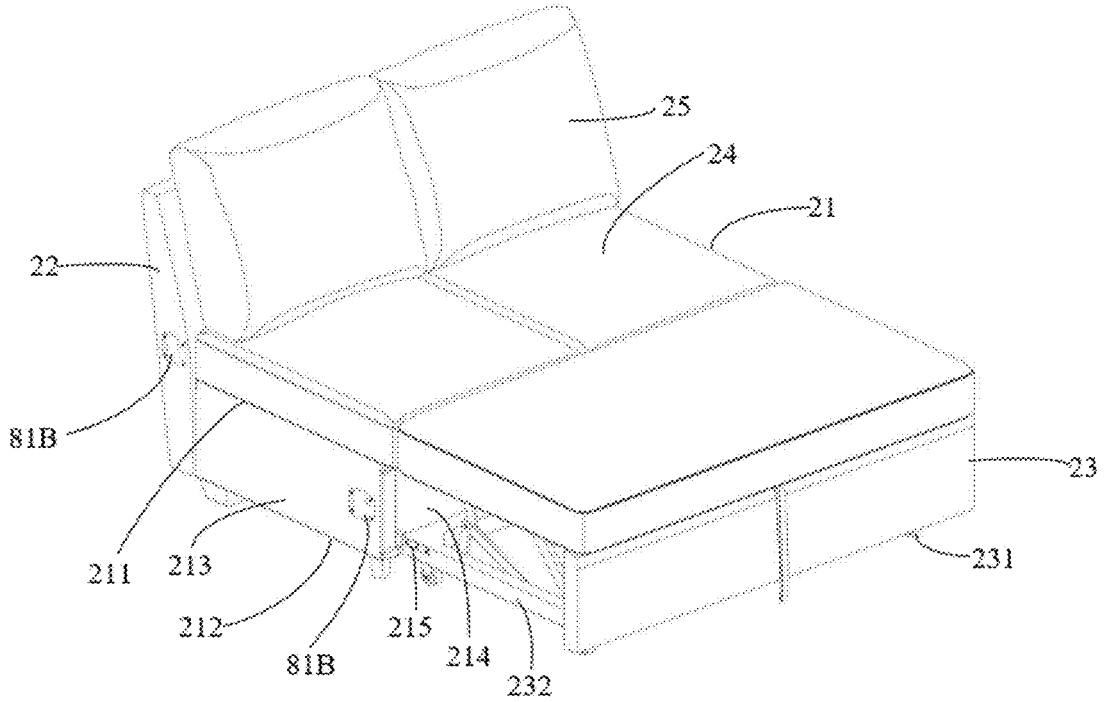
FIG. 3 is a schematic structural diagram of a pull-out sofa bed module related to a modular sofa according to the present invention.

Referring to FIG. 3, the pull-out sofa bed module 20 further includes: a second base portion 21, a second backrest portion 22, and a pull-out portion 23. The second base portion 21 and the second backrest portion 22 may be rapidly connected or detached, the second backrest portion 22 may provide stable leaning support for the user, and the pull-out portion 23 may be extended and retracted relative to the second base portion 21, so that the pull-out portion 23 may be pulled out from the second base portion 21 to form a sofa bed or accommodated into the second base portion 21 to form a sofa.

In some embodiments, the second base portion 21 further includes: a top surface 211, a bottom plate 212, and a side wall 213 connected to the top surface 211 and the bottom plate 212. The top surface 211, the bottom plate 212, and the side wall 213 are jointly enclosed to form accommodation space which is configured to accommodate the pull-out portion 23. In some embodiments, one side, away from the second backrest portion 22, of the second base portion 21 is provided with an opening 214, and the pull-out portion 23 may be pulled into or out of the second base portion 21 through the opening 214.

The pull-out sofa bed module 20 is designed to be multi-functional, which can not only allow the user to sit and lie, but also has a structure that supports conversion to a form of a bed to provide additional sleeping space. The pull-out portion 23 may be extended and retracted relative to the second base portion 21. When the pull-out portion 23 is pulled into the accommodation space in the second base portion 21, the pull-out sofa bed module 20 may be used as a sofa. When the pull-out portion 23 is pulled out of the accommodation space in the second base portion 21, the pull-out sofa bed module 20 may be used as a sofa bed.

A width of the pull-out portion 23 is basically consistent with a width of the second base portion 21, and the pull-out portion 23 may be docked with the second base portion 21 after being pulled out, thereby extending a length of the entire sofa, to form a complete plane bed. This design allows the modular sofa to be converted into a temporary bed rapidly without occupying additional space.

In some embodiments, pulling between the pull-out portion 23 and the second base portion 21 is implemented through a slide rail system. Specifically, a slide rail is disposed on each of two sides of the accommodation space in the second base portion 21, and a slide bar 232 is correspondingly disposed on the pull-out portion 23, so that the pull-out portion 23 may slide along the slide rails smoothly.

Further, a bottom portion of the pull-out portion 23 may be equipped with a roller wheel 231, and these roller wheels 231 provide movement support with low friction during pulling out or pushing into. The roller wheel 231 ensures that the pull-out portion 23 can move smoothly even under heavy loads and reduces abrasion to the bottom plate.

Further, to prevent the pull-out portion 23 from being excessively pulled out of the second base portion 21, the slide rail system is equipped with a limiting apparatus 215. The limiting apparatus 215 may be a physical stopper, a limiting angle iron, and the like, and the limiting apparatus is mounted at a tail end of the slide rail. When the pull-out portion 23 reaches a maximum pull-out position, the stopper may prevent further movement of the pull-out portion 23.

In some embodiments, the pull-out sofa bed module 20 further includes abase portion cushion 24, and a backrest portion cushion 25, which are configured to improve comfort during use.

A top surface of the pull-out portion 23 may be raised and lowered as required. Specifically, after the pull-out portion 23 is pulled out of the second base portion 21, the top surface of the pull-out portion 23 is ejected upward, to be flush with a top portion of the base portion cushion 24. When the pull-out portion 23 needs to be pulled into the second base portion 21, the top surface of the pull-out portion 23 is lowered, to enable the pull-out portion 23 to be smoothly accommodated into the second base portion 21. In some embodiments, the pull-out portion 23 is provided with a bed-forming hinge, which allows the top surface of the pull-out portion 23 to be raised or lowered smoothly along a predetermined path. In some embodiments, the top surface of the pull-out portion 23 may be raised and lowered by using a mechanical apparatus or another apparatus provided on the pull-out portion 23. The above apparatus may provide stable and uniform power support, so that the pull-out portion 23 may be raised or lowered smoothly.

The second base portion 21 and the second backrest portion 22 may be rapidly connected or detached without assistance of another tool during connection or detachment. Specifically, the second base portion 21 and the second backrest portion 22 may be rapidly connected or detached through the first type of connecting member 80A. The first inserting slot 81A of the first type of connecting member 80A is disposed on the second base portion 21, to form a receiving slot with an upward opening on a side wall of the second base portion 21, and the first inserting head 82A is disposed on the second backrest portion 22, to form an inserting head extending downward on a side surface of the second backrest portion 22.

Figure 4:
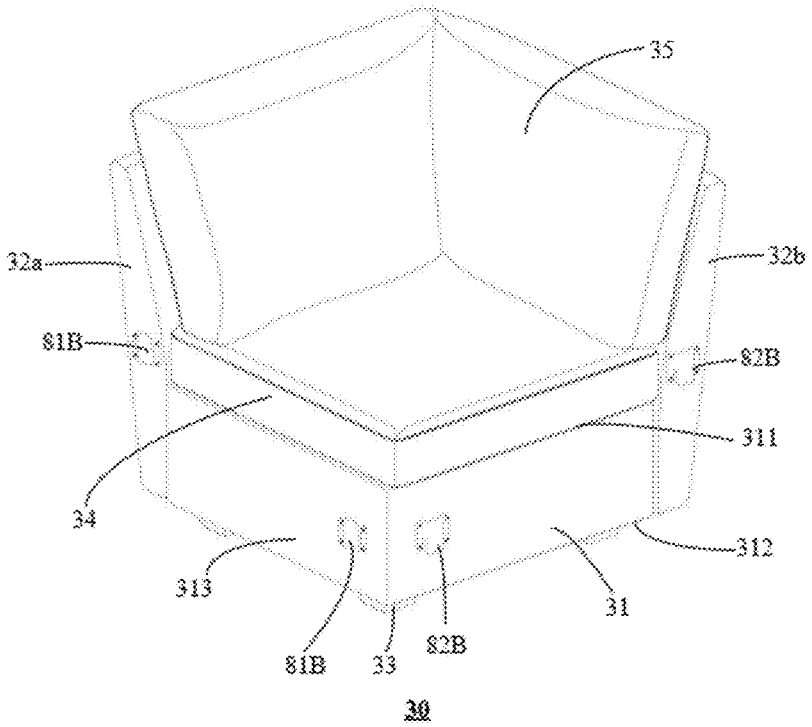
FIG. 4 is a schematic structural diagram of a corner seat module related to a modular sofa according to the present invention.

Referring to FIG. 4, the corner seat module 30 further includes a third base portion 31 and a third backrest portion 32 that are detachable.

The third base portion 31 may allow the user to sit and lie on the third base portion and provide solid support for the user. In some embodiments, the third base portion 31 further includes: a top cover 311, a bottom plate 312, and a side wall 313 connected to the top cover 311 and the bottom plate 312, where the top cover 311, the bottom plate 312, and the side wall 313 may be jointly enclosed to form accommodation space. In some embodiments, the top cover 311 of the third base portion 31 may be of a flap structure.

The third backrest portion 32 further includes two backrest portions 32*a* and 32*b* that may be rapidly connected or detached. The backrest portions 32*a* and 32*b* are disposed on two adjacent side walls 313 of the third base portion 31 respectively after being assembled, to form backrest structures that are adjacent and basically perpendicular to each other, thereby providing stable leaning support for the user. The above backrest structures are particularly suitable for being placed at a corner position of the sofa, thereby increasing a utilization rate of a seat and providing additional comfort.

The third base portion 31 and the third backrest portion 32 may be rapidly connected or detached without assistance of another tool during connection or detachment. Specifically, the third base portion 31 and the third backrest portion 32 may be rapidly connected or detached through the first type of connecting member 80A. The first inserting slot 81A of the first type of connecting member 80A is disposed on the third base portion 31, to form a receiving slot with an upward opening on a side surface of the third base portion 31, and the first inserting head 82A is disposed on the third backrest portion 32, to form an inserting head extending downward on a side surface of the third backrest portion 32.

In some embodiments, the corner seat module 30 may further include a foot pad 33, and the foot pad 33 is located on the bottom plate 312 of the third base portion 31. The foot pad 33 may enhance stability of the module, and the foot pad 33 is designed to be detachable and may be equipped with a roller wheel, thereby facilitating adjusting a position of the sofa by the user as required. The foot pad 33 may be mounted through an inserting hole provided on the bottom plate 312, thereby facilitating cleaning or replacement of the user when needed.

To improve sitting and lying comfort, the corner seat module 30 may also include a base portion cushion 34 and a backrest portion cushion 35. The base portion cushion 34 and the backrest portion cushion 35 may be accommodated in the accommodation space.

Figure 5:
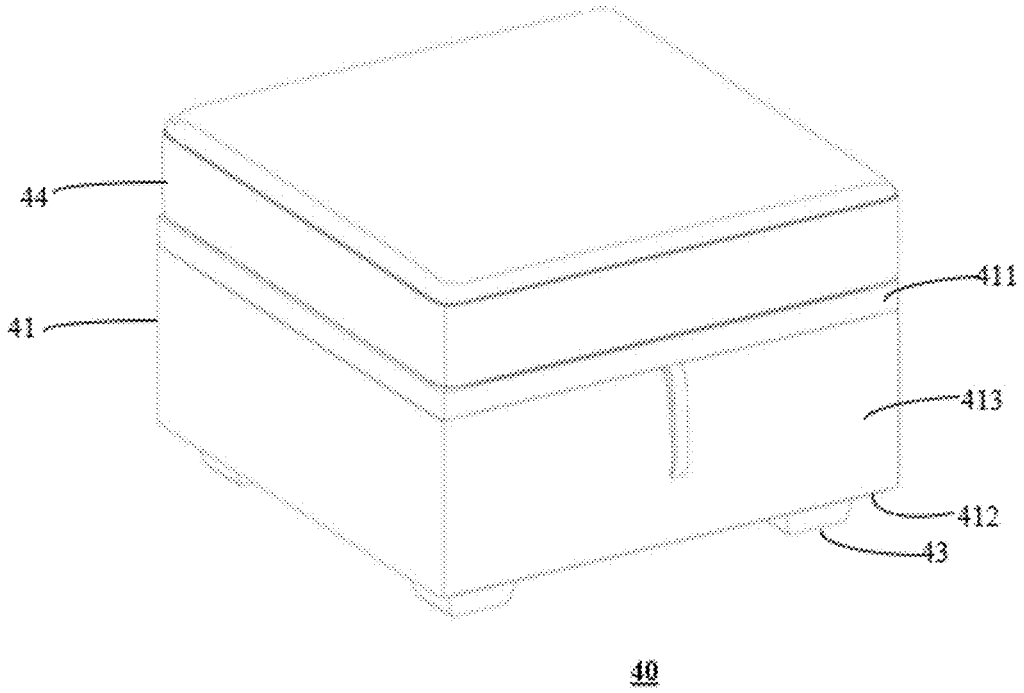
FIG. 5 is a schematic structural diagram of an ottoman module related to a modular sofa according to the present invention.
Figure 6:
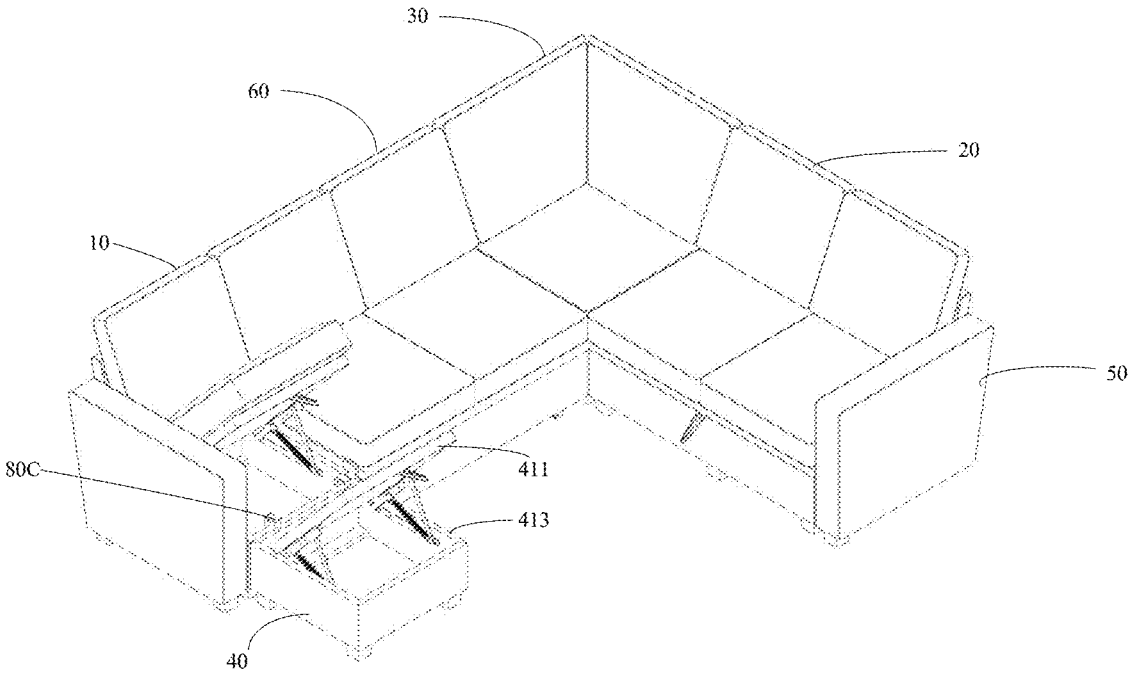
FIG. 6 is a schematic structural diagram of an ottoman module and a connection relationship thereof related to a modular sofa according to the present invention.

Referring to FIG. 5 and FIG. 6, the ottoman module 40 further includes a fourth base portion 41, which is configured to provide an additional seat or footrest support for the user. The fourth base portion 41 has a solid structure, can bear a heavy load, and may be used as a temporary seat for use at the same time.

In some embodiments, the fourth base portion 41 further includes: a top cover 411, a bottom plate 412, and a side wall 413 connected to the top cover 411 and the bottom plate 412, where the top cover 411, the bottom plate 412, and the side wall 413 jointly form storage space. The top cover 411 may be of a flap structure, to facilitate opening the storage space and accessing an item in the storage space by the user. As a specific example, a hinge is connected between the top cover 411 and the side wall 413, so that the top cover 411 may rotate relative to the side wall 413. When the top cover 411 is in a closed state, the top cover 411 is in complete contact with a top portion of the side wall 413, to form closed storage space. When the top cover 411 needs to be opened, the top cover 411 rotates relative to the side wall 413, a part of the top cover 411 is raised upward, and the other part thereof is flipped downward to enter the storage space.

The ottoman module 40 may be used in connection with another module or used independently without assistance of another tool during connection or detachment. Specifically, the ottoman module 40 may be rapidly connected or detached through a connecting member compatible with another module in the modular sofa. FIG. 11 shows a structure of an optional connecting member. In some embodiments, the ottoman module 40 is rapidly connected to or detached from another module through a third type of connecting member 80C. The third type of connecting member 80C includes a first side wall 801, a second side wall 802, and a connecting wall 803 connected to the first side wall 801 and the second side wall 802, where the first side wall 801 and the second side wall 802 are parallel and are disposed oppositely, and the first side wall 801 and the second side wall 802 are perpendicular to the connecting wall 803. When the ottoman module 40 needs to be connected to another module (for example, the single seat module 10), the ottoman module 40 is close to a to-be-connected module, to enable the side wall 413 of the ottoman module 40 to be in contact with a side wall of the to-be-connected module; and the third type of connecting member 80C slides downward along the above two to-be-connected side walls, to enable the two to-be-connected side walls to be located between the first side wall 801 and the second side wall 802. In some embodiments, a size of the connecting wall 803 is equal to or slightly greater than a sum of thicknesses of the two to-be-connected side walls, so that the first side wall 801 and the second side wall 802 are in close contact with the two to-be-connected side walls. In some embodiments, the first side wall 801 and the second side wall 802 are provided with a screw hole 804, so that the first side wall 801 and the second side wall 802 may be fixed to the side wall of the to-be-connected module through threaded connection, thereby increasing structural stability.

In some embodiments, the ottoman module 40 may further include a foot pad 43 at a bottom portion, and the foot pad 43 is located on the bottom plate 412 of the fourth base portion 41. The foot pad 43 may enhance stability of the module, and the foot pad 43 is designed to be detachable and may be equipped with a roller wheel, thereby facilitating adjusting a position of the sofa by the user as required. The foot pad 43 may be mounted through an inserting hole provided on the bottom plate 412, thereby facilitating cleaning or replacement of the user when needed.

In some embodiments, the ottoman module 40 further includes a layer of detachable cushion 44, providing additional comfort. The cushion 44 may be placed or removed as required by the user and may be stored in the storage space of the base portion 41 when not in use.

Figure 7:
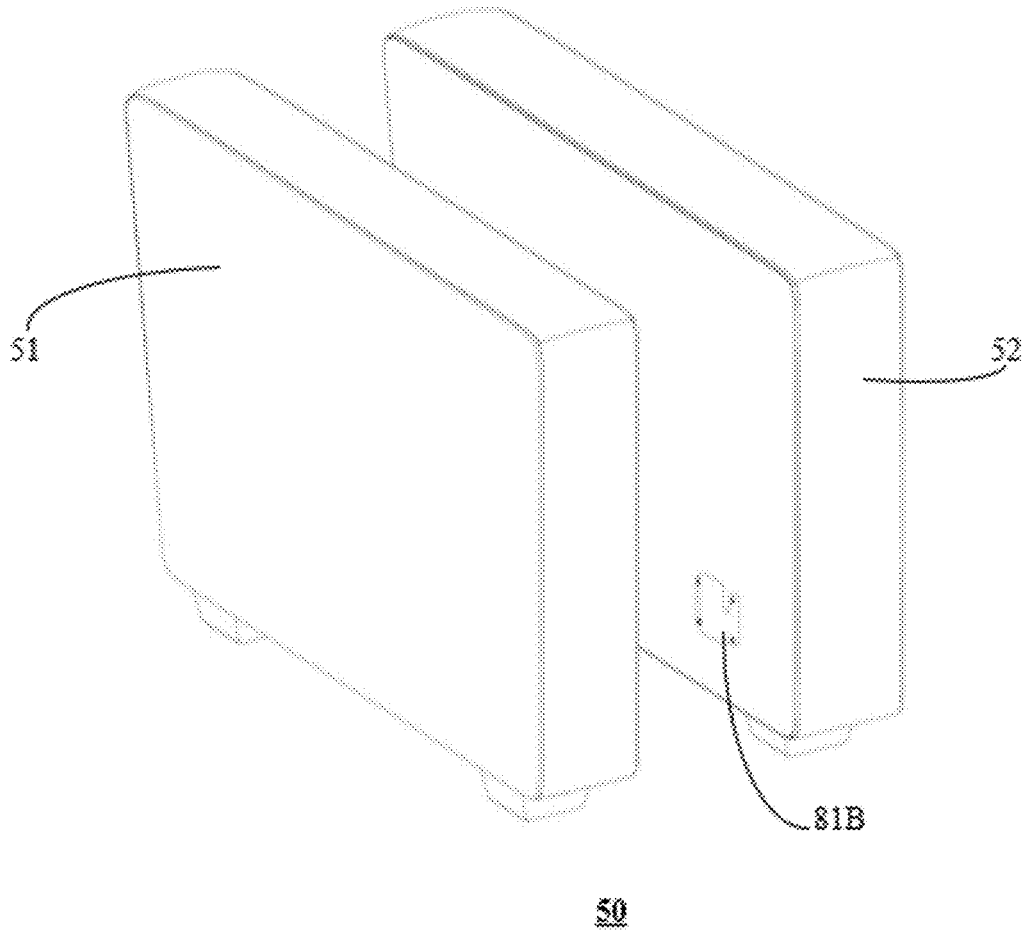
FIG. 7 is a schematic structural diagram of an armrest module related to a modular sofa according to the present invention.

Referring to FIG. 7, the armrest module 50 includes a left-side armrest portion 51 and/or a right-side armrest portion 52. The armrest module 50 may be configured to support an arm or place a small item. The armrest module 50 may be connected to or detached from another functional module, for example, rapidly connected to or detached from the single seat module 10, the pull-out sofa bed module 20, the corner seat module 30, the love seat module 60, and the like through a second type of connecting member 80B.

Figure 8:
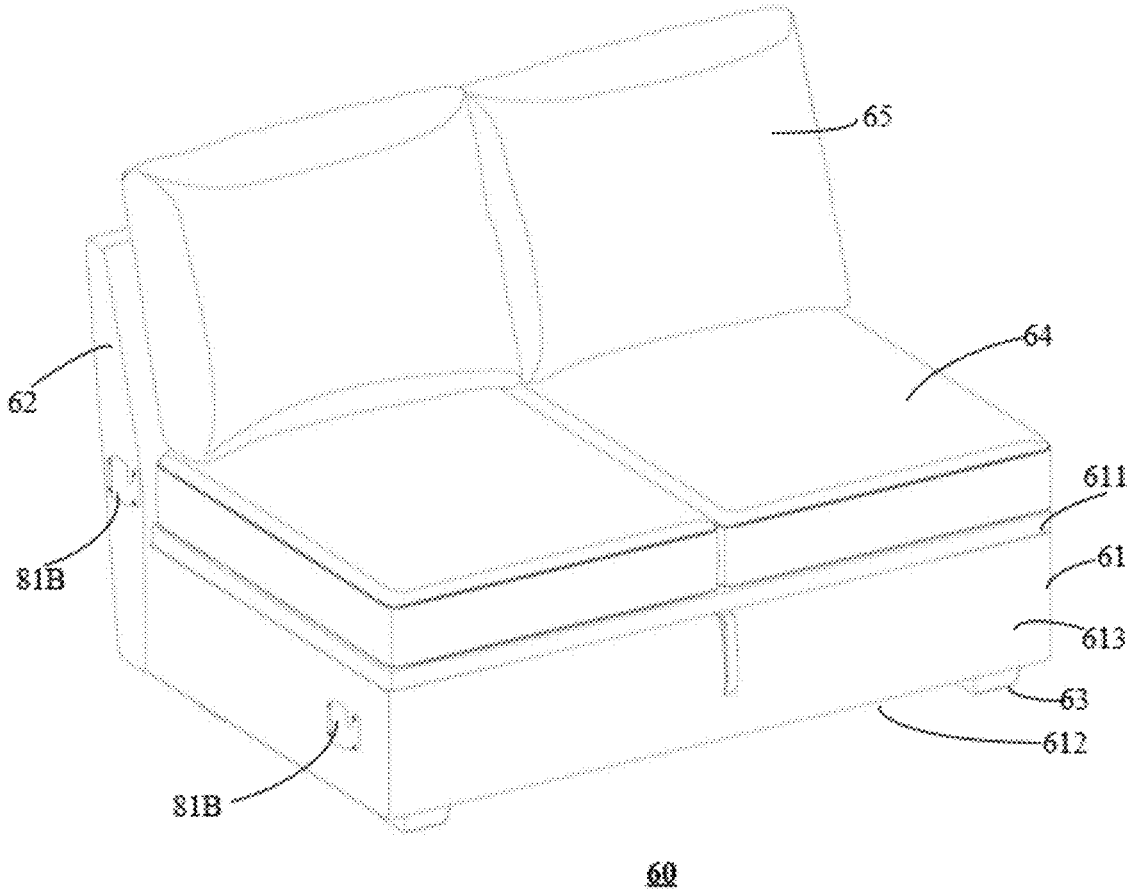
FIG. 8 is a schematic structural diagram of a love seat module related to a modular sofa according to the present invention.

Referring to FIG. 8, a structure of the love seat module 60 is similar to that of the single seat module 10, and a main difference is that the love seat module 60 has a wider width and is suitable for two or more persons. The love seat module 60 further includes a sixth base portion 61 and a sixth backrest portion 62 that are detachable. The sixth base portion 61 may allow a plurality of users to sit or lie on the sixth base portion and provide solid support for the user. The sixth backrest portion 62 may provide stable leaning support for the user.

In some embodiments, the sixth base portion 61 further includes: a top cover 611, a bottom plate 612, and a side wall 613 connected to the top cover 611 and the bottom plate 612, where the top cover 611, the bottom plate 612, and the side wall 613 may be jointly enclosed to form storage space. In some embodiments, the top cover 611 of the sixth base portion 61 may be of a flap structure, and an item in the storage space may be accessed by opening the top cover 611. The storage space may be configured to store a living sundry, an accessory of the modular sofa, and the like, thereby increasing practicability of the modular sofa.

The sixth base portion 61 and the sixth backrest portion 62 may be rapidly connected or detached without assistance of another tool during connection or detachment. Specifically, the sixth base portion 61 and the sixth backrest portion 62 may be rapidly connected or detached through the first type of connecting member 80A. The first inserting slot 81A of the first type of connecting member 80A is disposed on the sixth base portion 61, to form a receiving slot with an upward opening on a side wall of the sixth base portion 61, and the first inserting head 82A is disposed on the sixth backrest portion 62, to form an inserting head extending downward on a side surface of the sixth backrest portion 62.

In some embodiments, the love seat module may further include a foot pad 63, and the foot pad 63 is located on the bottom plate 612 of the sixth base portion 61. The foot pad 63 may improve stability of the sofa. In some embodiments, the foot pad 63 may further be equipped with a roller wheel, to facilitate moving the sofa by the user. The foot pad 63 may be designed to be of a detachable structure. In some embodiments, an inserting hole used to be connected to the foot pad 63 is formed on the bottom plate 612 of the sixth base portion 61, and the foot pad 63 may be inserted into the bottom plate 612 of the sixth base portion 61, to facilitate cleaning and replacement.

In some embodiments, the love seat module further includes a base portion cushion 64, and a backrest portion cushion 65, which are configured to improve comfort during use. The base portion cushion 64 and the backrest portion cushion 65 may be stored in the storage space and taken out or accommodated from the storage space as required, thereby providing a flexible use manner for the user.

An embodiment of the present application further provides a modular sofa including the above one or more functional modules.

In some embodiments, the modular sofa includes: at least one pull-out sofa bed module 20 and at least one module of a single seat module 10, a corner seat module 30, an ottoman module 40, an armrest module 50, and a love seat module 60.

In some embodiments, to ensure that various modules in the modular sofa can be matched smoothly for use, there is a certain correspondence between sizes of various modules. For example, if a length, a width, and a height (including a first base portion 11 and a base portion cushion 14) that are of the single seat module 10 are a datum length (D), a datum width (W), and a datum height (H), a length, a width, and a height that are of another module may be an integral multiple of a datum unit. Specifically, a height of the pull-out sofa bed module 20 may be the datum height (H), a width thereof may be twice the datum width (W). When the pull-out sofa bed module is used as a sofa, a length thereof is equal to the datum length (D), and when the pull-out sofa bed module is used as a sofa bed, a length thereof is expanded to a sum of the datum length (D) and the datum width (W). A height of the corner seat module 30 may be the datum height (H), and a width and a length that are of the corner seat module 30 are equal and may be the datum length (D). A height of the ottoman module 40 may be the datum height (H), and a width and a length that are of the ottoman module 40 are equal and may be the datum width (W). A length of the armrest module 50 may be the datum length (D). A height of the love seat module 60 may be the datum height (H), a width thereof may be twice the datum width (W), and a length thereof may be the datum length (D).

In some embodiments, the datum length (D) may range from 30 inches to 35 inches, for example, 32.7 inches; the datum width (W) may range from 20 inches to 25 inches, for example, 22.8 inches; and the datum height (H) may range from 14 inches to 18 inches, for example, 15.7 inches.

The modular sofa provided in the present application may be composed of a plurality of functional modules that are detachable. Sizes of various functional modules have a specific correspondence and meet a specific range, thereby facilitating transportation through a standard express delivery service and reducing logistics costs.

In some embodiments, various modules are connected to each other through a connecting member. FIG. 10 shows a structure of an optional connecting member. In some embodiments, modules are rapidly connected or detached through a second type of connecting member 80B. The second type of connecting member 80B further includes a second inserting slot 81B and a second inserting head 82B matched with the second inserting slot 81B. Structures of the second inserting slot 81B and the second inserting head 82B are basically the same and are both approximate to "m" shapes.

Specifically, the second inserting slot 81B includes a first inserting slot wall 811B, a second inserting slot wall 812B, and a third inserting slot wall 813B that are sequentially arranged in parallel, and a connecting wall 814B connected to the above first inserting slot wall 811B, the second inserting slot wall 812B, the third inserting slot wall 813B. The first inserting slot wall 811B and the third inserting slot wall 813B are located on a same plane and are symmetrically disposed relative to the second inserting slot wall 812B. The first inserting slot wall 811B and the third inserting slot wall 813B are provided with screw holes 83B, so that the first inserting slot wall 811B and the third inserting slot wall 813B may be fixed to a side wall of a sofa module through threaded connection. The second inserting slot wall 812B protrudes outward relative to the first inserting slot wall 811B and the third inserting slot wall 813B, to form a receiving slot, with an upward opening, configured to be matched with the second inserting head 82B.

Specifically, a structure of the second inserting head 82B is basically the same as that of the second inserting slot 81B and includes a first inserting head wall 821B, a second inserting head wall 822B, and a third inserting head wall 823B that are sequentially arranged in parallel, and a connecting wall 824B connected to the above first inserting head wall 821B, the second inserting head wall 822B, the third inserting head wall 823B. The first inserting head wall 821B and the third inserting head wall 823B are located on a same plane and are symmetrically disposed relative to the second inserting head wall 822B. The first inserting head wall 821B and the third inserting head wall 823B are provided with screw holes 83B, so that the first inserting head wall 821B and the third inserting head wall 823B may be fixed to a side wall of a sofa module through threaded connection. The second inserting head wall 822B protrudes outward relative to the first inserting head wall 821B and the third inserting head wall 823B, to form an inserting head extending downward, and the inserting head is inserted into the second inserting slot 81B during assembly.

The second type of connecting member 80B may be configured to be connected to various functional modules in the modular sofa, for example, configured for connection between the single seat module 10, the pull-out sofa bed module 20, the corner seat module 30, the armrest module 50, and the love seat module 60, to implement rapid detachment and assembly of the above various modules.

Figure 12:
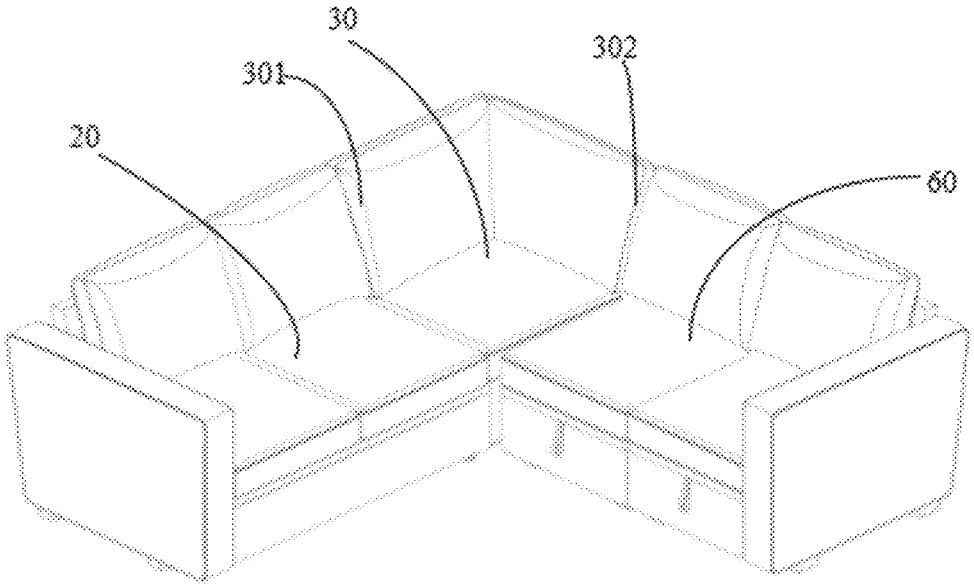
FIG. 12 and FIG. 13 are schematic structural diagrams of a modular sofa according to an embodiment of the present invention.
Figure 13:
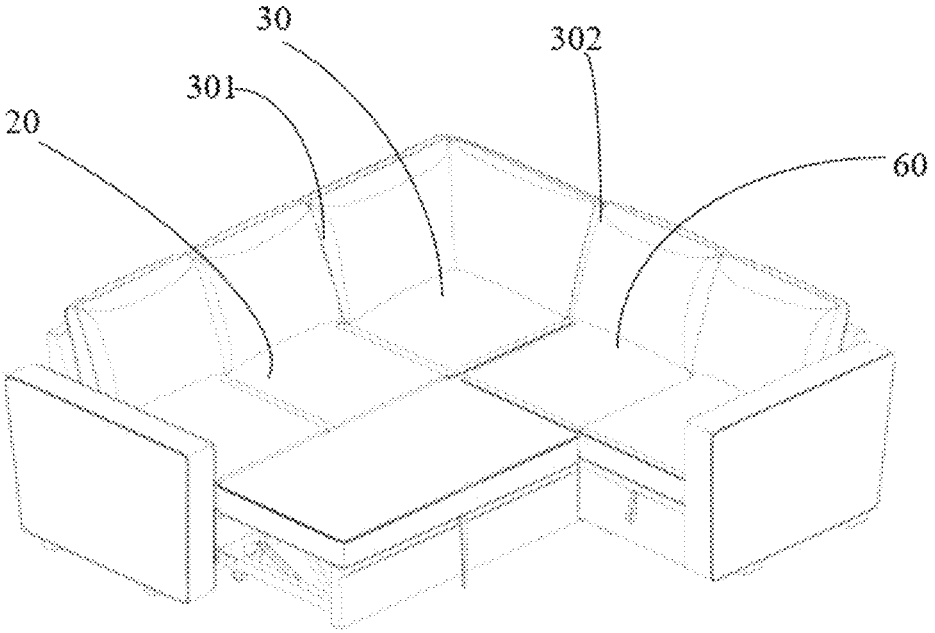

Referring to FIG. 12 and FIG. 13, in some embodiments, the modular sofa includes:

one corner seat module 30;

one pull-out sofa bed module 20, configured to be connected to a first side surface 301 of the corner seat module 30; and one single seat module 10 or one love seat module 60, configured to be connected to a second side surface 302 of the corner seat module 30, where the first side surface 301 is adjacent to the second side surface 302.

FIG. 12 shows that a pull-out portion of the pull-out sofa bed module 20 is located in a second base portion, to be used as a sofa. FIG. 13 shows that the pull-out portion of the pull-out sofa bed module 20 is pulled out of the second base portion, to be used as a sofa bed.

Figure 14:
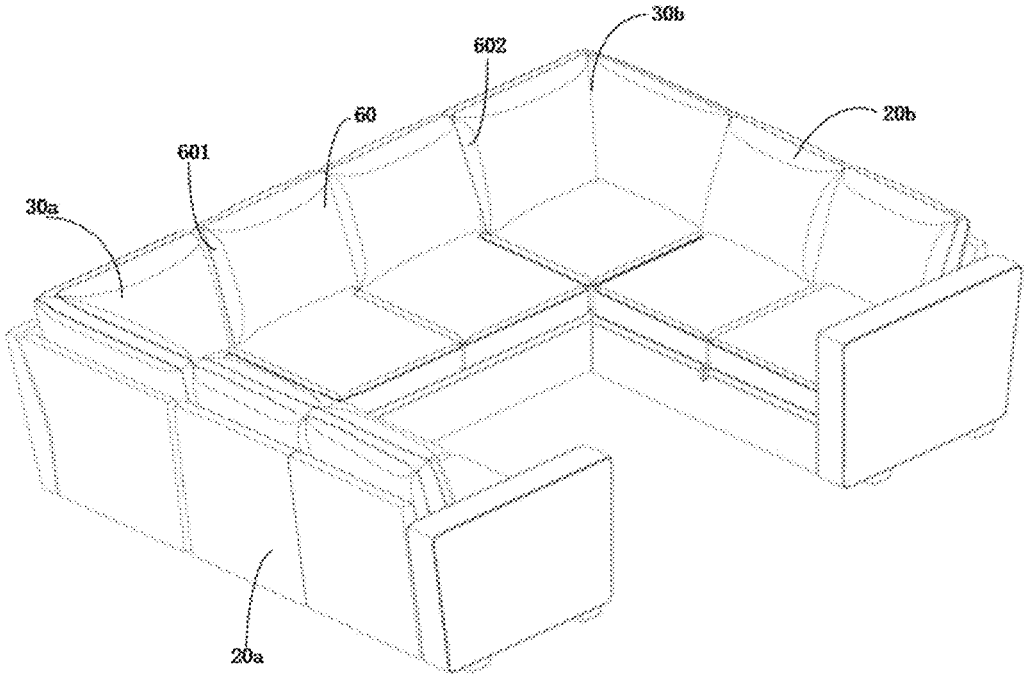
FIG. 14 and FIG. 15 are schematic structural diagrams of a modular sofa according to an embodiment of the present invention.
Figure 15:
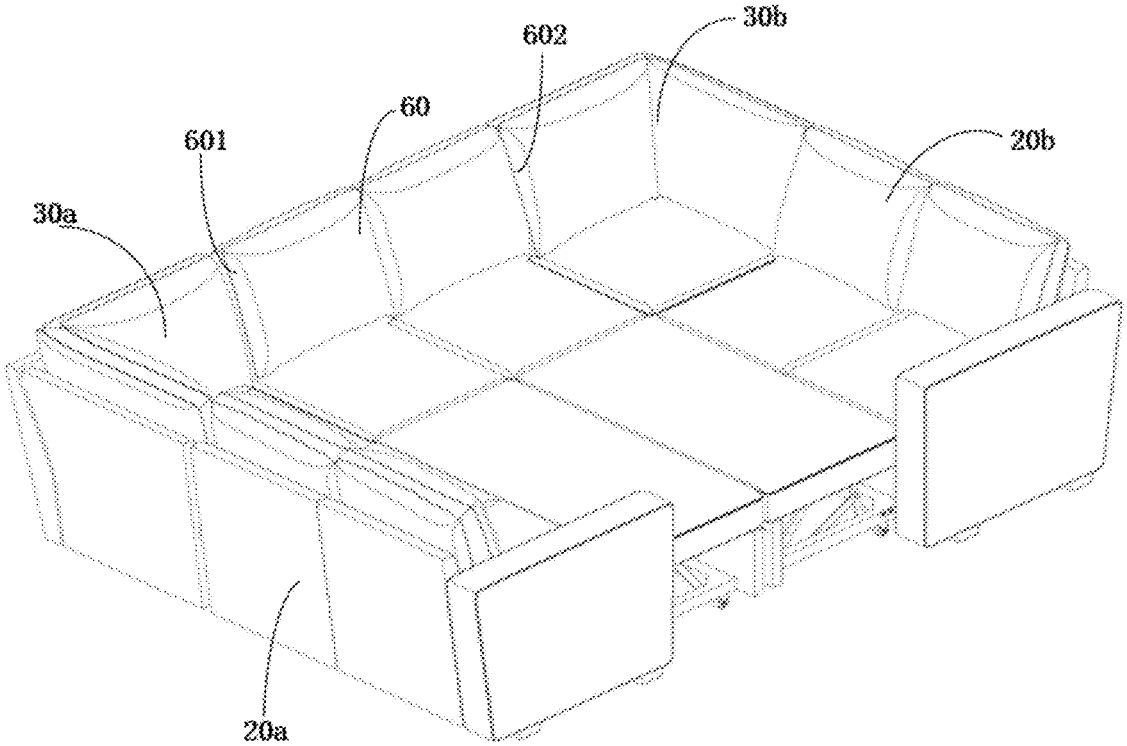

Referring to FIG. 14 and FIG. 15, in some embodiments, the modular sofa includes:

one love seat module 60;

two corner seat modules 30, respectively being a first corner seat module 30*a* and a second corner seat module 30*b*, where the first corner seat module 30*a* is configured to be connected to a first side surface 601 of the love seat module 60, the second corner seat module 30*b* is configured to be connected to a second side surface 602 of the love seat module 60, and the first side surface 601 is opposite to the second side surface 602; and two pull-out sofa bed modules 20, respectively being a first pull-out sofa bed module 20*a* and a second pull-out sofa bed module 20*b*, where the first pull-out sofa bed module 20*a* is configured to be connected to the first corner seat module 30*a*, and the second pull-out sofa bed module 20*b* is configured to be connected to the second corner seat module 30*b*.

FIG. 14 shows that pull-out portions of the pull-out sofa bed modules 20*a* and 20*b* are located in second base portions, to be used as sofas. FIG. 15 shows that the pull-out portions of the pull-out sofa bed modules 20*a* and 20*b* are pulled out of the second base portions, to be used as sofa beds.

Figure 16:
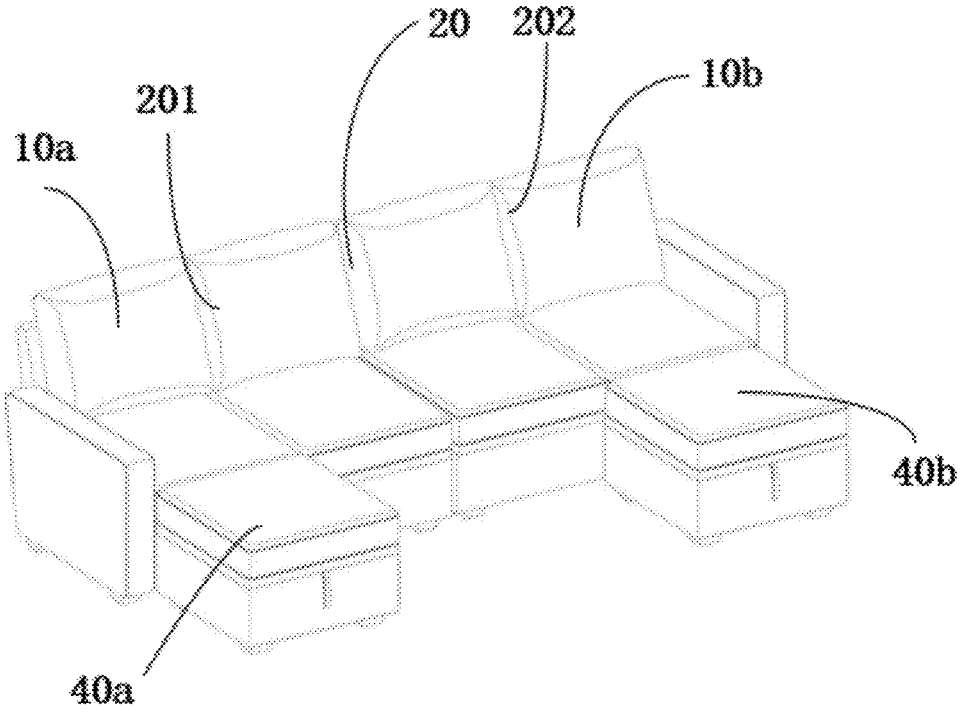
FIG. 16 and FIG. 17 are schematic structural diagrams of a modular sofa according to an embodiment of the present invention.
Figure 17:
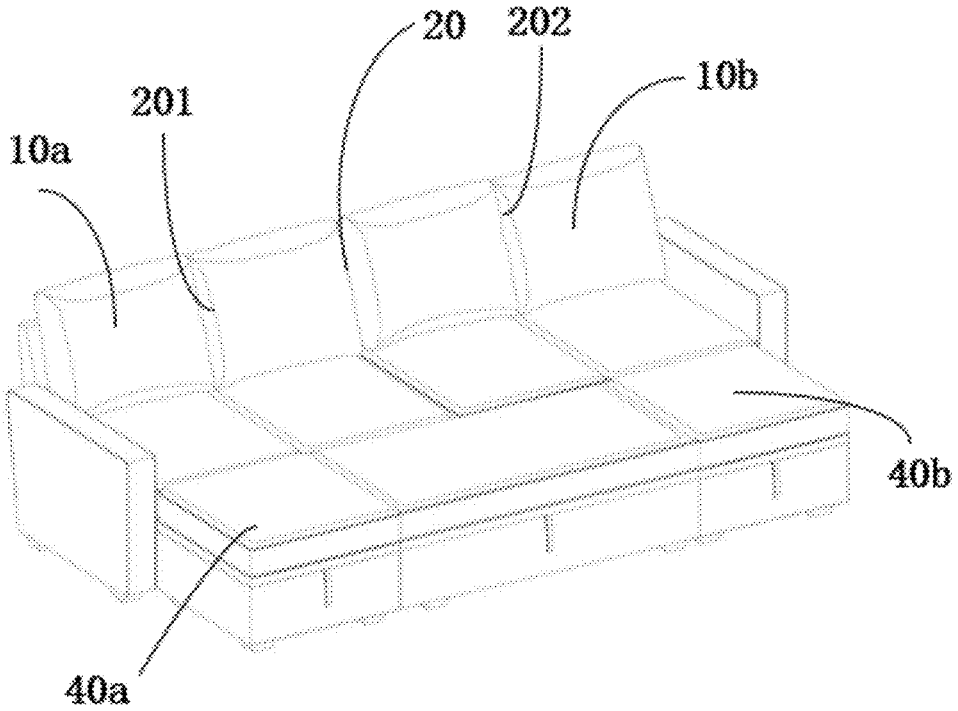

Referring to FIG. 16 and FIG. 17, in some embodiments, the modular sofa includes:

one pull-out sofa bed module 20;

two single seat modules 10, respectively being a first single seat module 10*a* and a second single seat module 10*b*, where the first single seat module 10*a* is configured to be connected to a first side surface 201 of the pull-out sofa bed module 20, the second single seat module 10*b* is configured to be connected to a second side surface 202 of the pull-out sofa bed module 20, and the first side surface 201 is opposite to the second side surface 202; and two ottoman modules 40, respectively being a first ottoman module 40*a* and a second ottoman module 40*b* and respectively configured to be connected to the first single seat module 10*a* and the second single seat module 10*b*.

FIG. 16 shows that a pull-out portion of the pull-out sofa bed module 20 is located in a second base portion, to be used as a sofa. FIG. 17 shows that the pull-out portion of the pull-out sofa bed module 20 is pulled out of the second base portion, to be used as a sofa bed.

Figure 18:
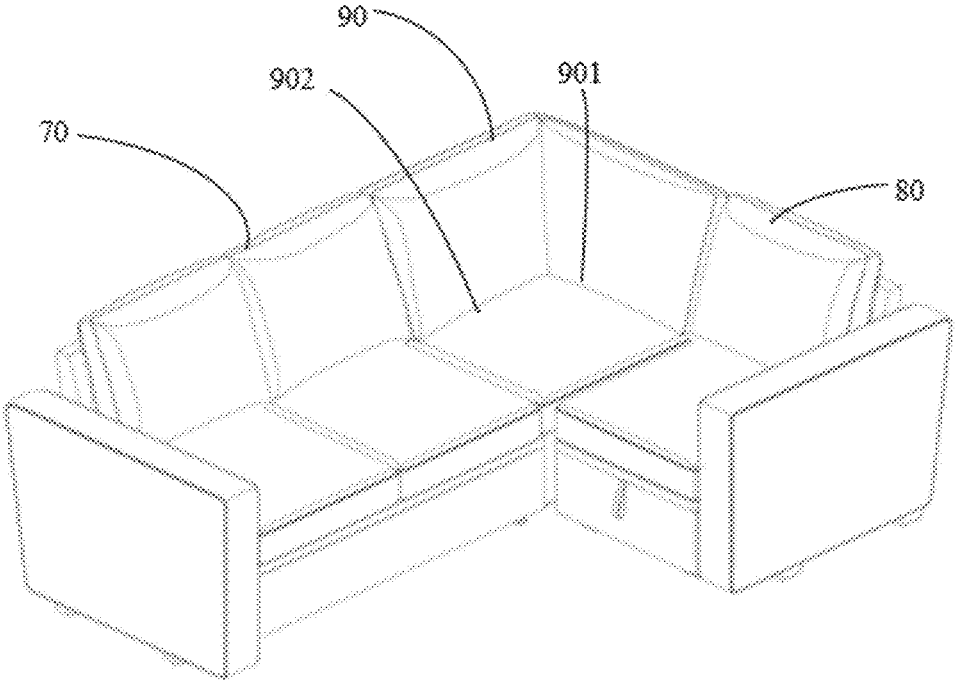
FIG. 18 and FIG. 19 are schematic structural diagrams of a modular sofa according to an embodiment of the present invention.
Figure 19:
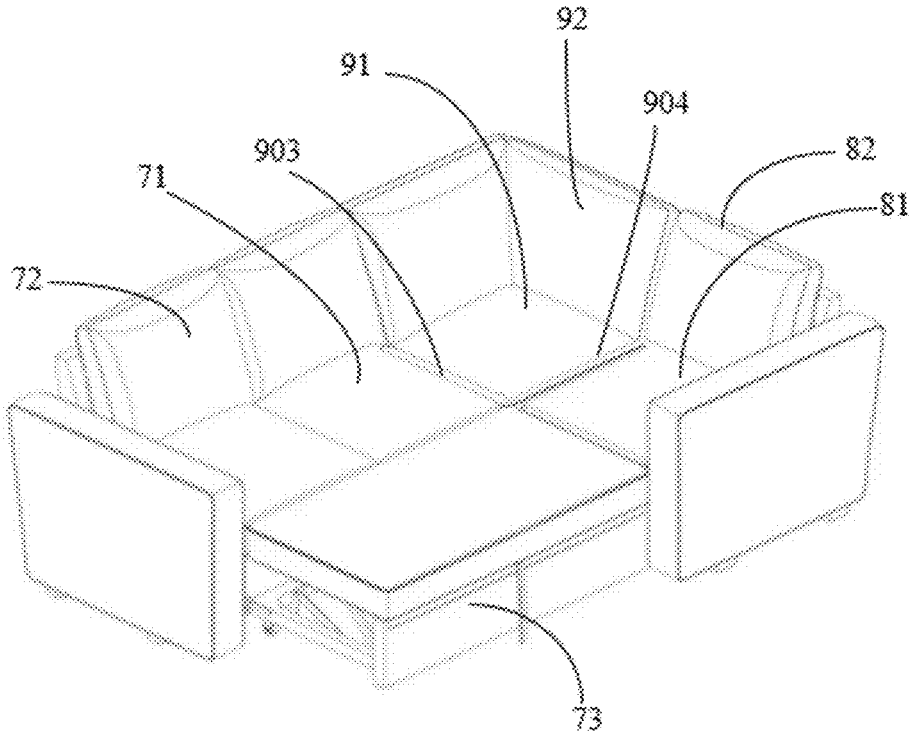

Referring to FIG. 18 and FIG. 19, an embodiment of the present application further provides a modular sofa, including: a pull-out sofa bed module 70, a single or love seat module 80, and a corner seat module 90.

The pull-out sofa bed module 70 includes: a sofa bed base portion 71, a sofa bed backrest portion 72, and a pull-out portion 73, where the sofa bed backrest portion 72 is configured to provide leaning support for a user; the pull-out portion 73 may be extended and retracted relative to the sofa bed base portion 71; as shown in FIG. 18, when the pull-out portion 73 is pulled into the sofa bed base portion 71, the pull-out sofa bed module 70 is used as a sofa; and as shown in FIG. 19, when the pull-out portion 73 is pulled out of the sofa bed base portion 71, the pull-out sofa bed module 70 is used as a sofa bed.

The single or love seat module 80 includes a seat base portion 81 and a seat backrest portion 82, where the seat base portion of the single seat module may allow an individual to sit on the single seat module, the love seat module is configured to allow at least two users to sit on the love seat module, and the seat backrest portion 82 is configured to provide leaning support for the user.

The corner seat module 90 includes: a corner seat base portion 91 and a corner seat backrest portion 92, where the corner seat backrest portion 92 is disposed on a first side wall 901 and a second side wall 902 that are adjacent and that are of the corner seat base portion 91, to form backrest structures that are adjacent and basically perpendicular to each other; and a third side wall 903 of the corner seat base portion is opposite to the first side wall 901 and is configured to be connected to the pull-out sofa bed module 70, and a fourth side wall 904 of the corner seat base portion is opposite to the second side wall 902 and is configured to be connected to the single or love seat module 80.

It should be noted that connection between various modules may be customized according to an actual requirement. Although specific embodiments are given in the specification, there may be other possible combination and connection manners. The user may select the most appropriate connection manner according to individual specific needs and preferences, so as to flexibly adjust furniture layout to adapt to different space and use scenarios. It may be seen that, compared with the prior art, the present invention provides an improved modular sofa design, which may integrate sofa and bed functions, optimize a size to adapt to a transportation standard, increase flexibility of combinations, simplify a mounting process, and provide a storage function, thereby improving user experience and meeting diversified requirements of a modern family.

It should be noted that various embodiments in the specification are described in a progressive manner, each embodiment focuses on the differences from other embodiments, and the same or similar parts between the various embodiments can be seen with reference to each other. An apparatus embodiment is basically similar to a method embodiment, and therefore is described briefly; and for related parts, reference may be made to partial descriptions in the method embodiment.

The above embodiments are merely intended for describing the technical solutions of the present disclosure, but not for limiting the present disclosure. Although the present disclosure is described in detail with reference to the foregoing embodiments, those of ordinary skill in the art should understand that modifications to the technical solutions recorded in the foregoing embodiments or equivalent replacements to some technical features thereof may still be made without departing from the spirit and scope of the technical solutions of the embodiments of the present disclosure.

What is claimed is:

1. A modular sofa, comprising:

at least one pull-out sofa bed module, wherein the pull-out sofa bed module comprises a second base portion, a second backrest portion, and a pull-out portion, wherein the second backrest portion is configured to provide leaning support for a user, the pull-out portion may be extended and retracted relative to the second base portion, when the pull-out portion is pulled into the second base portion, the pull-out sofa bed module is used as a sofa, and when the pull-out portion is pulled out of the second base portion, the pull-out sofa bed module is used as a sofa bed; and the second base portion and the second backrest portion are connected through a first type of connecting member; and at least one module of a single seat module, a corner seat module, an ottoman module, and a love seat module, wherein the pull-out sofa bed module, the corner seat module, and the love seat module are connected through a second type of connecting member;

wherein the second type of connecting member comprises a second inserting slot and a second inserting head matched with the second inserting slot;

wherein the second inserting slot comprises a first inserting slot wall, a second inserting slot wall, and a third inserting slot wall that are sequentially arranged in parallel, and a connecting wall connected to the first inserting slot wall, the second inserting slot wall, and the third inserting slot wall, the connecting wall being located below the slot walls when assembled;

wherein the second inserting head has the same structure as the second inserting slot, and the connecting wall of the second inserting head being located above the slot walls when assembled.

2. The modular sofa according to claim 1, wherein the first type of connecting member comprises a first inserting slot and a first inserting head matched with the first inserting slot, wherein a width of the first inserting slot and a width of the first inserting head gradually decrease along an inserting direction.

3. The modular sofa according to claim 2, wherein wherein the first inserting slot wall and the third inserting slot wall are located on a same plane and are symmetrical relative to the second inserting slot wall, and the second inserting slot wall protrudes outward relative to the first inserting slot wall and the third inserting slot wall, to form a receiving slot with an upward opening.

4. The modular sofa according to claim 2, wherein the single seat module comprises a first base portion and a first backrest portion that are detachable, wherein the first base portion is configured to allow the user to sit on the first base portion, and the first backrest portion is configured to provide leaning support for the user; and the first base portion and the first backrest portion are connected through the first type of connecting member.

5. The modular sofa according to claim 4, wherein the love seat module comprises a sixth base portion and a sixth backrest portion that are detachable, wherein the sixth base portion is configured to allow at least two users to sit on the sixth base portion, and the sixth backrest portion is configured to provide leaning support for the user; the sixth base portion and the sixth backrest portion are connected through the first type of connecting member; and a width of the sixth base portion is greater than or equal to twice a width of the first base portion.

6. The modular sofa according to claim 1, wherein the modular sofa comprises the pull-out sofa bed module and an armrest module.

7. The modular sofa according to claim 6, wherein the armrest module comprises a left-side armrest portion and/or a right-side armrest portion; and the armrest module is connected to the single seat module, the pull-out sofa bed module, the corner seat module, or the love seat module through the second type of connecting member.

8. The modular sofa according to claim 1, wherein pulling between the pull-out portion and the second base portion is implemented through a slide rail system, wherein a slide rail is disposed on each of two sides in the second base portion, a slide bar is correspondingly disposed on the pull-out portion, and a limiting angle iron is disposed at a tail end of the slide rail.

9. The modular sofa according to claim 1, wherein the pull-out portion is provided with a bed-forming hinge, so that a top surface of the pull-out portion is raised or lowered along a predetermined path.

10. The modular sofa according to claim 1, wherein the corner seat module comprises a third base portion and a third backrest portion that are detachable, wherein the third base portion is configured to allow the user to sit on the third base portion, the third backrest portion comprises two backrest portions that are detachable, and the two backrest portions are disposed on two adjacent side walls of the third base portion respectively after being assembled, to form backrest structures that are adjacent and perpendicular to each other.

11. The modular sofa according to claim 1, wherein the ottoman module comprises a fourth base portion, and the fourth base portion further comprises a top cover, a bottom plate, and a side wall connected to the top cover and the bottom plate, wherein the top cover is of a flap structure and may rotate relative to the side wall; when the top cover is closed, the top cover, the bottom plate, and the side wall are enclosed to form closed storage space; and when the top cover is opened, a first portion of the top cover is raised upward, and a second portion of the top cover is flipped downward to enter the storage space.

12. The modular sofa according to claim 11, wherein the ottoman module is connected to another module through a third type of connecting member, and the third type of connecting member comprises a first side wall, a second side wall, and a connecting wall connected to the first side wall and the second side wall, wherein the first side wall is in parallel and opposite to the second side wall, to form a first gap for accommodating side walls of two to-be-connected modules, and the connecting wall is perpendicular to the first side wall.

13. The modular sofa according to claim 1, comprising:

one corner seat module;

one pull-out sofa bed module, configured to be connected to a first side surface of the corner seat module; and one love seat module, configured to be connected to a second side surface of the corner seat module, wherein the first side surface is adjacent to the second side surface.

14. The modular sofa according to claim 1, comprising:

one love seat module;

two corner seat modules, respectively being a first corner seat module and a second corner seat module, wherein the first corner seat module is configured to be connected to a first side surface of the love seat module, the second corner seat module is configured to be connected to a second side surface of the love seat module, and the first side surface is opposite to the second side surface; and two pull-out sofa bed modules, respectively being a first pull-out sofa bed module and a second pull-out sofa bed module, wherein the first pull-out sofa bed module is configured to be connected to the first corner seat module, and the second pull-out sofa bed module is configured to be connected to the second corner seat module.

15. The modular sofa according to claim 1, comprising:

one pull-out sofa bed module;

two single seat modules, respectively being a first single seat module and a second single seat module, wherein the first single seat module is configured to be connected to a first side surface of the pull-out sofa bed module, the second single seat module is configured to be connected to a second side surface of the pull-out sofa bed module, and the first side surface is opposite to the second side surface; and two ottoman modules, respectively configured to be connected to the first single seat module and the second single seat module.

* * * * *